US010240873B2

(12) United States Patent
Tseng et al.

(10) Patent No.: US 10,240,873 B2
(45) Date of Patent: Mar. 26, 2019

(54) JOINT ASSEMBLY OF VAPOR CHAMBERS

(71) Applicant: TAI-SOL ELECTRONICS CO., LTD., Taipei (TW)

(72) Inventors: Chuan-Chi Tseng, Taipei (TW); Wen-Ching Liao, Taipei (TW); Ming-Quan Cui, Wujiang (TW)

(73) Assignee: TAI-SOL ELECTRONICS CO., LTD., Taipei (TW)

( * ) Notice: Subject to any disclaimer, the term of this patent is extended or adjusted under 35 U.S.C. 154(b) by 66 days.

(21) Appl. No.: 15/710,116

(22) Filed: Sep. 20, 2017

(65) Prior Publication Data

US 2019/0041138 A1 Feb. 7, 2019

(30) Foreign Application Priority Data

Aug. 4, 2017 (TW) ..... 106126326 A

(51) Int. Cl.
*F28D 15/02* (2006.01)
*F28D 15/04* (2006.01)

(52) U.S. Cl.
CPC ..... *F28D 15/046* (2013.01); *F28D 15/0233* (2013.01)

(58) Field of Classification Search
CPC ..... F28D 15/02; F28D 15/0233; F28D 15/04; F28D 15/046
USPC ..... 165/104.26
See application file for complete search history.

(56) References Cited

U.S. PATENT DOCUMENTS

2012/0111538 A1* 5/2012 Wang ..... F28D 15/0266 165/104.21
2014/0165402 A1 6/2014 Chen
2014/0182819 A1* 7/2014 Yang ..... F28D 15/04 165/104.26
2017/0343295 A1* 11/2017 Lan ..... F28D 15/0266
2017/0343297 A1* 11/2017 Lan ..... F28D 15/0233

* cited by examiner

*Primary Examiner* — Eric Ruppert
(74) *Attorney, Agent, or Firm* — Muncy, Geissler, Olds & Lowe, P.C.

(57) ABSTRACT

A joint assembly of vapor chambers connects the vapor chambers to effectuate joint operation thereof. For example, two paired vapor chambers are connected therebetween by a capillary pipe and a gas pipe. The capillary pipe is filled with a third wick which connects with a first wick and a second wick in the two vapor chambers. The two vapor chambers are in spatial communication with each other because of the gas pipe. A working fluid in the two vapor chambers is transferred between the first, second and third wicks by capillarity. The gas-phase working fluid moves between the two vapor chambers via the gas pipe, thereby allowing the two vapor chambers to operate jointly.

6 Claims, 8 Drawing Sheets

JOINT ASSEMBLY OF VAPOR CHAMBERS

BACKGROUND OF THE INVENTION

1. Technical Field

The present invention relates to vapor chambers and, more particularly, to a joint assembly of vapor chambers for operating the vapor chambers jointly.

2. Description of Related Art

A conventional vapor chamber includes a metallic closed container. A wick and a working fluid are disposed in the metallic closed container. Uniform distribution of temperature in the vapor chamber is achieved, because of quick heat transfer therein. The quick heat transfer occurs, because of phase change of the working fluid between liquid phase and gas phase as well as the wick which the liquid-phase working fluid flows along quickly. US 2014/0165402 A1 discloses a structure similar to the aforesaid one.

However, a vapor chamber has to be disposed on every heat source of a device in order to dissipate heat from device, resulting in a drawback: efficiency of heat dissipation varies from vapor chamber to vapor chamber, because of heat dissipation taking place in the vapor chambers separately, difference in power between the heat sources, and difference in size between the vapor chambers. By contrast, a single vapor chamber adhered to multiple heat sources is not effective in dissipating heat because of increased thermal resistance. Thermal resistance increases, because of poor contact between a single plane and the multiple heat sources. The single plane is in poor contact with the multiple heat sources, because the single plane differs from the multiple heat sources in height tolerance.

The aforesaid drawbacks of the prior art can be overcome by a solution, that is, communication between internal spaces of vapor chambers and thus joint operation of the vapor chambers. Unfortunately, similar solutions, such as connecting vapor chambers to enable a working fluid therein to flow through the vapor chambers, are unavailable.

The aforesaid solution also eliminates the aforesaid drawbacks, that is, poor contact and low efficiency of heat dissipation, which might otherwise occur to a single vapor chamber for joint use by multiple heat sources.

BRIEF SUMMARY OF THE INVENTION

It is an objective of the present invention to provide a joint assembly of vapor chambers, characterized in that vapor chambers are connected so that spaces therein are in communication with each other, allowing the vapor chambers to operate jointly.

Another objective of the present invention is to provide a joint assembly of vapor chambers, characterized in that vapor chambers are connected so that spaces therein are in communication with each other, allowing the vapor chambers to be adhered to heat sources, respectively, and thus solving the problem with thermal resistance arising from contact with multiple heat sources.

In order to achieve the above and other objectives, the present invention provides a joint assembly of vapor chambers, comprising: at least two vapor chambers, a capillary pipe and a gas pipe which are each connected between two paired ones of the at least two vapor chambers, defining one of the two paired vapor chambers as a first vapor chamber, and defining the other vapor chamber as a second vapor chamber, wherein the first vapor chamber has a casing which is panel-shaped, with a first room disposed in the casing, a first wick disposed on an inner wall surface of the casing and in the first room, the first room not fully occupied with the first wick, and the casing of the first vapor chamber is penetrated by a first connection hole and a first gas hole, with the first gas hole being in spatial communication with a first through-hole of the first wick, wherein the second vapor chamber has a casing which is panel-shaped, with a second room disposed in the casing, a second wick disposed on an inner wall surface of the casing and in the second room, the second room not fully occupied with the second wick, and the casing of the second vapor chamber is penetrated by a second connection hole and a second gas hole, with the second gas hole being in spatial communication with a second through-hole of the second wick, wherein two ends of the capillary pipe are connected to the casings of the first vapor chamber and the second vapor chamber and thereby are in communication with the first connection hole and the second connection hole, respectively, and the capillary pipe is filled with a third wick, with the third wick extending into the first connection hole and connecting with the first wick in the first vapor chamber, also with the third wick extending into the second connection hole and connecting with the second wick in the second vapor chamber, thereby allowing the third wick in the capillary pipe to close a cross section of the capillary pipe and prevent passage of gas, wherein two ends of the gas pipe are connected to the casings of the first vapor chamber and the second vapor chamber and thereby are in communication with the first gas hole, the second gas hole, the first through-hole and the second through-hole, respectively, so that the first room and the second room are in spatial communication with each other because of the gas pipe, and a working fluid filled in the first room and the second room and absorbed by the first wick, the second wick and the third wick as a result of the connection of the first wick, the second wick and the third wick.

Therefore, vapor chambers are connected so that spaces therein are in communication with each other, allowing the vapor chambers to operate jointly and to be adhered to heat sources, respectively, and thus solving the problem with thermal resistance arising from contact with multiple heat sources.

DETAILED DESCRIPTION OF THE INVENTION

Figure 1:
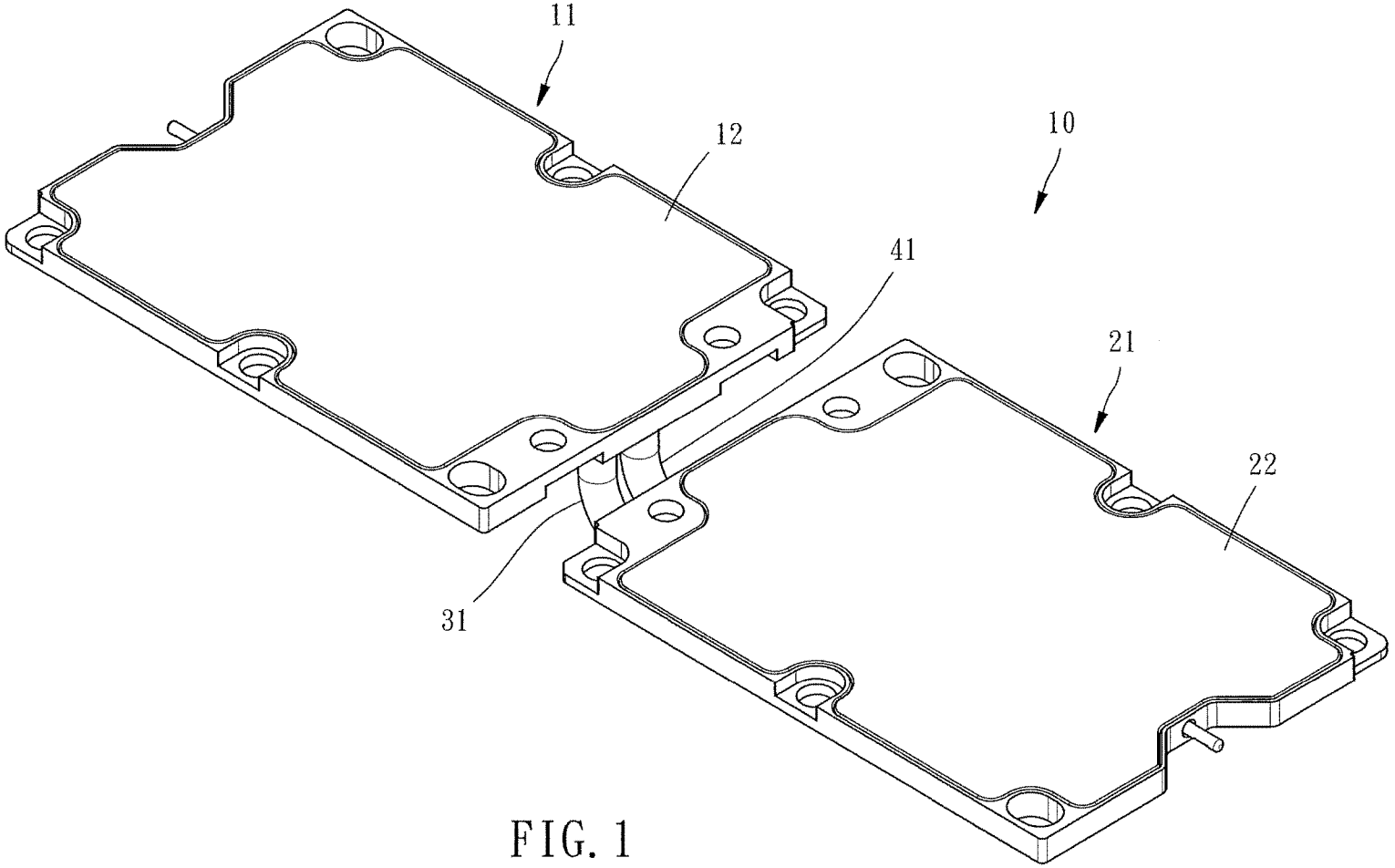
FIG. 1 is a perspective view of a joint assembly of vapor chambers according to the first preferred embodiment of the present invention.

Technical features of the present invention are illustrated with preferred embodiments, depicted by accompanying drawings, and described below.

Referring to FIG. 1 through FIG. 5, a joint assembly 10 of vapor chambers, provided according to the first preferred embodiment of the present invention, comprises at least two vapor chambers, a capillary pipe and a gas pipe which are each connected between two paired ones of the at least two vapor chambers, and a working fluid. The first preferred embodiment of the present invention involves specifying how to connect two vapor chambers, defining one of the vapor chambers as a first vapor chamber 11, and defining the other vapor chamber as a second vapor chamber 21.

The first vapor chamber 11 has a casing 12 which is panel-shaped. A first room 14 is disposed in the casing 12. A first wick 16 is disposed on the inner wall surface of the casing 12 and in the first room 14. The first room 14 is not fully occupied with the first wick 16. The casing 12 of the first vapor chamber 11 is penetrated by a first connection hole 121 and a first gas hole 122. The first wick 16 has a first through-hole 162 in spatial communication with the first gas hole 122. The first wick 16 is in form of copper powder, copper copper mesh, fiber bundles, grooves disposed on the inner wall surface of the casing 12, or a combination thereof. The first connection hole 121 and the first gas hole 122 are disposed on the same side of the casing 12 of the first vapor chamber 11, but the present invention is not limited thereto. In a variant embodiment of the present invention, the first connection hole 121 and the first gas hole 122 are disposed on different sides of the casing 12 of the first vapor chamber 11 as needed.

The second vapor chamber 21 has a casing 22 which is panel-shaped. A second room 24 is disposed in the casing 22. A second wick 26 is disposed on the inner wall surface of the casing 22 and in the second room 24. The second room 24 is not fully occupied with the second wick 26. The casing 22 of the second vapor chamber 21 is penetrated by a second connection hole 221 and a second gas hole 222. The second wick 26 has a second through-hole 262 in spatial communication with the second gas hole 222. The second wick 26 is in form of copper powder, copper copper mesh, fiber bundles, grooves disposed on the inner wall surface of the casing 22, or a combination thereof. The second connection hole 221 and the second gas hole 222 are disposed on the same side of the casing 22 of the second vapor chamber 21, but the present invention is not limited thereto. In a variant embodiment of the present invention, the second connection hole 221 and the second gas hole 222 are disposed on different sides of the casing 22 of the second vapor chamber 21 as needed.

The two ends of the capillary pipe 31 are connected to the casings 12, 22 of the first vapor chamber 11 and the second vapor chamber 21 and thereby are in communication with the first connection hole 121 and the second connection hole 221, respectively. The capillary pipe 31 is filled with a third wick 36. The third wick 36 extends into the first connection hole 121 and connects with the first wick 16 in the first vapor chamber 11. The third wick 36 also extends into the second connection hole 221 and connects with the second wick 26 in the second vapor chamber 21. The third wick 36 is in form of copper powder, copper copper mesh, fiber bundles, or a combination thereof. Alternatively, the third wick 36 is formed by sintering a combination of a groove capillary structure disposed on the wall of the capillary pipe 31 and one of the copper powder, copper copper mesh, and fiber bundles. The third wick 36 in the capillary pipe 31 closes the cross section of the capillary pipe 31 to prevent passage of gas. In practice, the capillary pipe 31 is completely filled and thus becomes solid, which the first preferred embodiment is illustrated with. In a variant embodiment, as with a conventional heat pipe, the third wick 36 is disposed only on the wall of the capillary pipe 31, and then the capillary pipe 31 is filled at any point thereof with solid copper powder to close the cross section of the capillary pipe 31. The variant embodiment is easy to understand directly and thus is not shown in the accompanying drawings.

Figure 2:
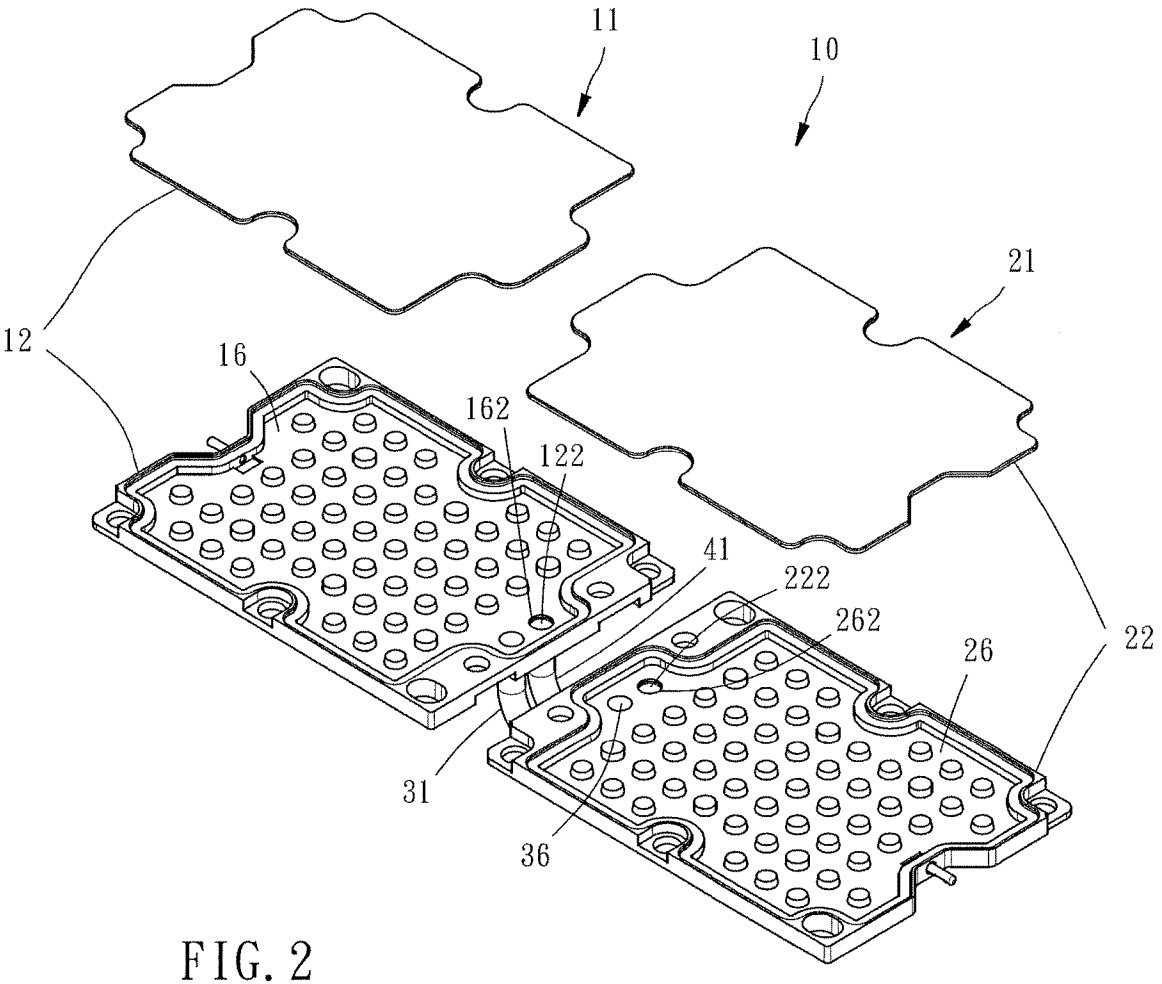
FIG. 2 is a partial exploded view of the joint assembly of vapor chambers according to the first preferred embodiment of the present invention.
Figure 3:
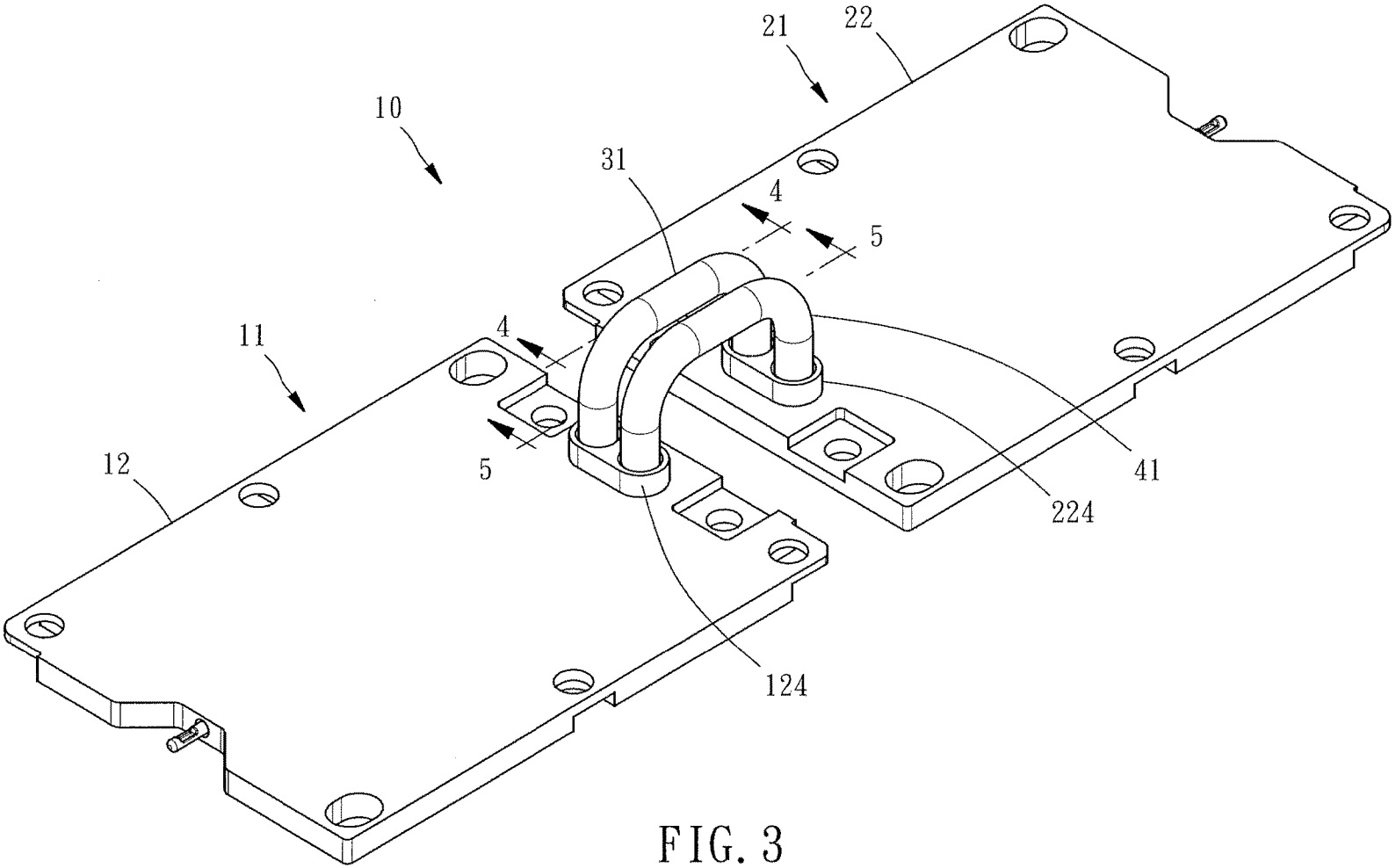
FIG. 3 is another perspective view, taken from a vertically opposite angle (opposite to that of FIG. 1), of the joint assembly of vapor chambers according to the first preferred embodiment of the present invention.
Figure 4:
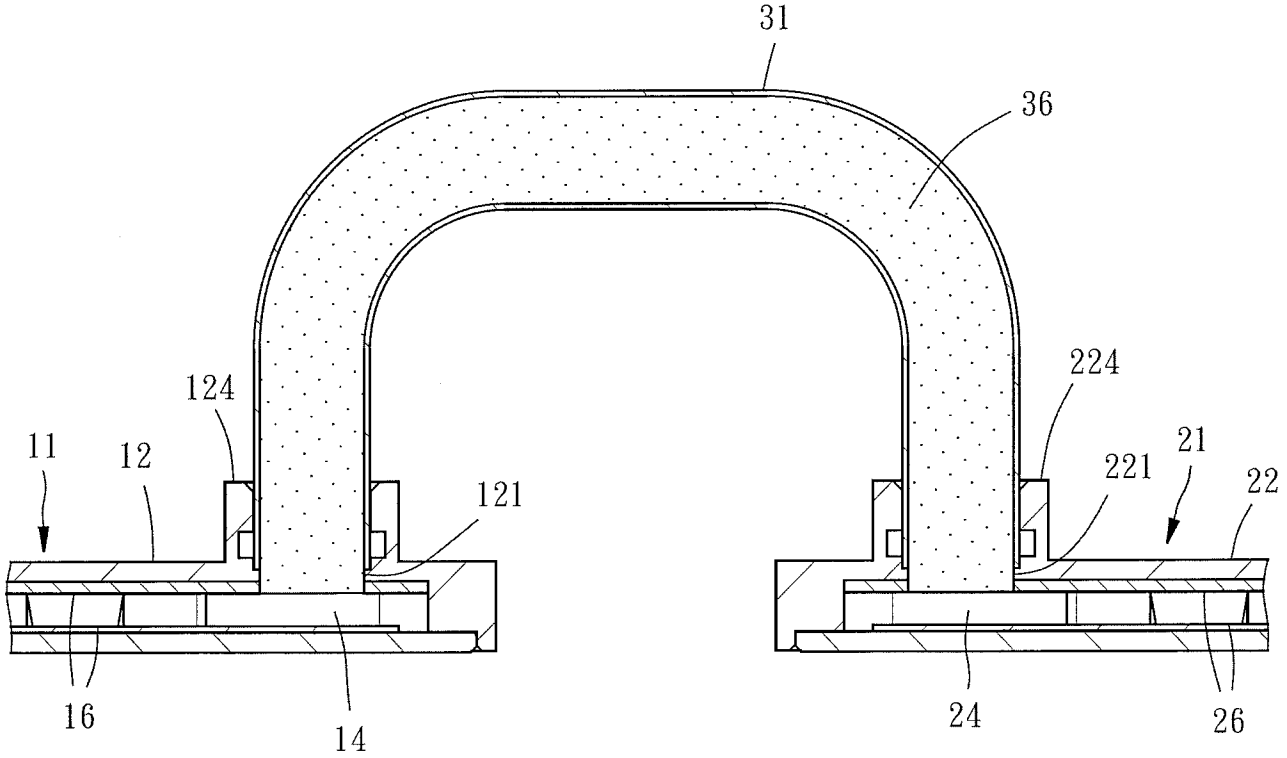
FIG. 4 is a cross-sectional view of the joint assembly of vapor chambers taken along line 4-4 of FIG. 3.

In the first preferred embodiment, the portion of the third wick 36, which extends into the first connection hole 121 and connects with the first wick 16, is solid, whereas the portion of the third wick 36, which extends into the second connection hole 221 and connects with the second wick 26, is also solid. The third wick 36 is sintered together with the first wick 16 and the second wick 26 and thereby connected to the first wick 16 and the second wick 26, as shown in FIG. 2 and FIG. 4.

The two ends of the gas pipe 41 are connected to the casings 12, 22 of the first vapor chamber 11 and the second vapor chamber 21 to therefore not only be in communication with the first gas hole 122 and the second gas hole 222 but also be in communication with the first through-hole 162 and the second through-hole 262, respectively, thereby allowing the first room 14 and the second room 24 to be in spatial communication with each other because of the gas pipe 41.

The working fluid is filled in the first room 14 and the second room 24. The working fluid is absorbed by the first wick 16, the second wick 26 and the third wick 36 as a result of the connection of the first wick 16, the second wick 26 and the third wick 36. The working fluid is not shown, not only because it is well known among persons skilled in the art, but also because it is absorbed by the wicks and thus cannot be graphically presented.

Coupling the capillary pipe 31 and the gas pipe 41 to the first vapor chamber 11 and the second vapor chamber 21 necessitates performing the following process: forming a coupling wall 124 which rises from rims of the first connection hole 121 and the first gas hole 122 of the casing 12 of the first vapor chamber 11 so that the coupling wall 124 surrounds terminal circumferential surfaces of the capillary pipe 31 and the gas pipe 41, and forming a coupling wall 224 which rises from rims of the second connection hole 221 and the second gas hole 222 of the casing 22 of the second vapor chamber 21 so that the coupling wall 224 surrounds terminal circumferential surfaces of the capillary pipe 31 and the gas pipe 41. Therefore, the capillary pipe 31 and the gas pipe 41 are surrounded by the coupling walls 124, 224 of the first vapor chamber 11 and the second vapor chamber 21 and thus can be easily welded and sealed.

The framework of the joint assembly of vapor chambers in the first preferred embodiment is described above. The operation of the joint assembly of vapor chambers in the first preferred embodiment is described below.

Before use, two heat sources (not shown) are adhered to the first vapor chamber 11 and the second vapor chamber 21 in such a manner that the heat sources do not correspond in position to the capillary pipe 31 and the gas pipe 41, respectively. Alternatively, a heat source is adhered to one of the two vapor chambers 11, 21. Both the aforesaid two arrangements are effective in dissipating heat and achieving uniform distribution of temperature. Preferably, the gas pipe and the capillary pipe are positioned side by side and disposed on the same sides of the two vapor chambers 11, 21. The joint assembly of vapor chambers of the present invention is hereunder illustrated with two heat sources.

Figure 5:
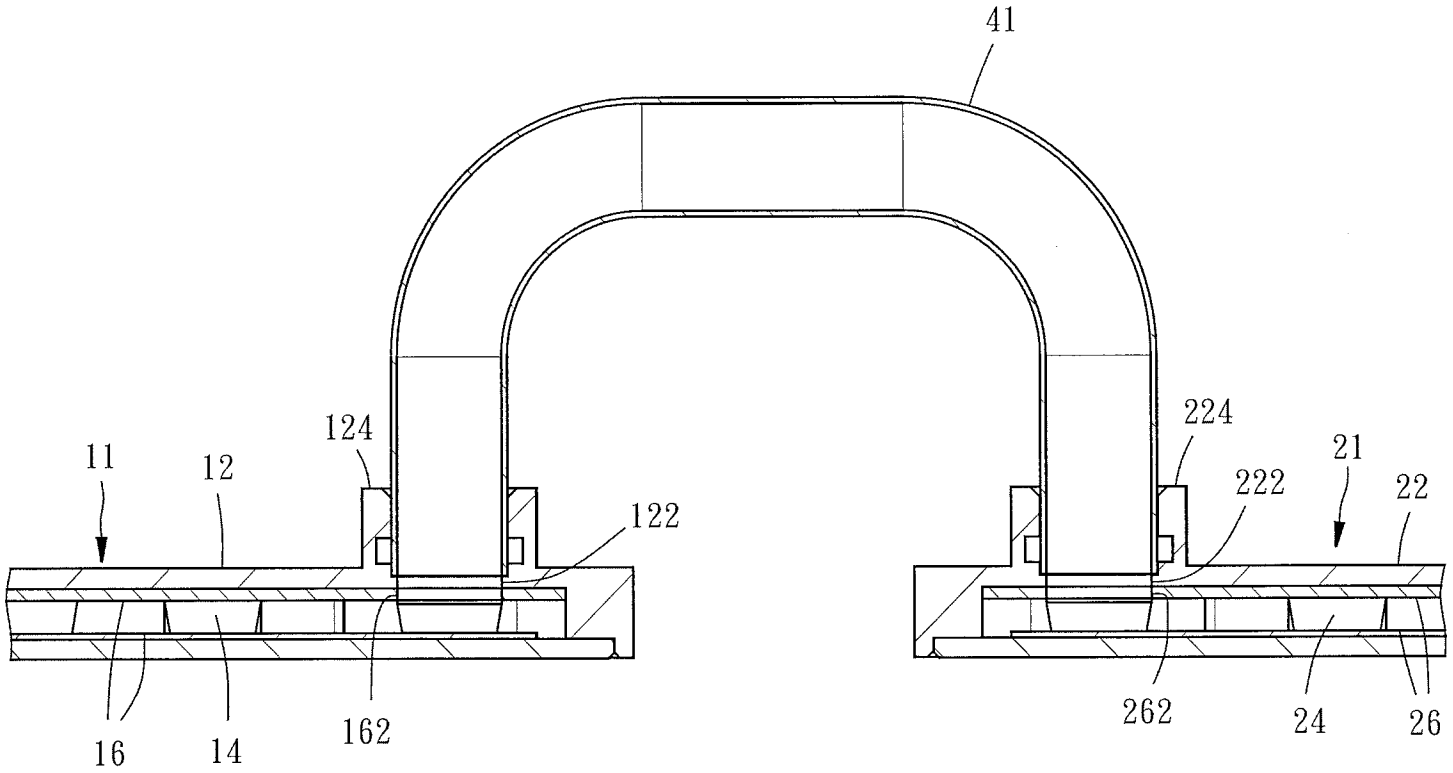
FIG. 5 is a cross-sectional view of the joint assembly of vapor chambers taken along line 5-5 of FIG. 3.

Referring to FIG. 4 and FIG. 5, heat generated from the two heat sources in operation is transferred to the first vapor chamber 11 and the second vapor chamber 21, respectively. Take the first vapor chamber 11 as an example, heat generated from a heat source heats up the working fluid absorbed by the first wick 16 until the working fluid evaporates into the gas phase, enters the first room 14, moves to the second room 24 via the gas pipe 41, and finally reaches equilibrium. The gas-phase working fluid condenses into the liquid phase upon contact with any points of the two vapor chambers 11,12, except for those points which the heat sources are adhered to and those points which cooling fins are not adhered to. The aforesaid points which the gas-phase working fluid comes into contact with and condenses into the liquid phase are cooler than the other points. The resultant liquid-phase working fluid in the first room 14 and the second room 24 is absorbed by the first wick 16 and the second wick 26 and then returned to the first wick 16 or any other wick which contains a smaller amount of the working fluid via the third wick 36, thereby reaching equilibrium and transferring heat with uniform distribution of temperature. The second vapor chamber 21 dissipates heat in the same way as the first vapor chamber 11 and thus, for the sake of brevity, is not described hereunder. After operating for a period of time, the first vapor chamber 11 and the second vapor chamber 21 achieve uniform distribution of temperature by liquid-gas phase change of the working fluid.

Figure 6:
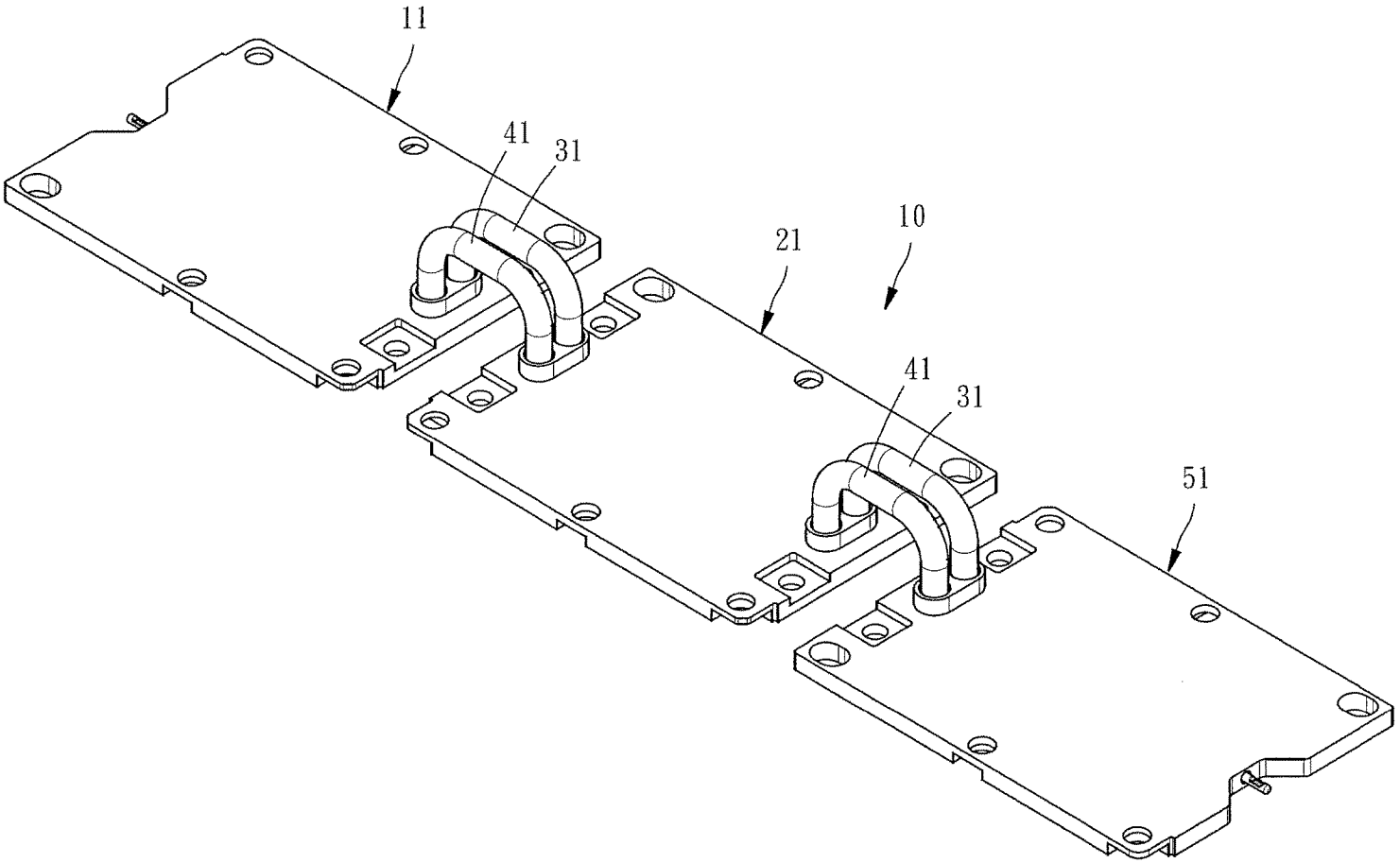
FIG. 6 is a perspective view of the joint assembly of vapor chambers in another combination according to the first preferred embodiment of the present invention.

Although the present invention is illustrated above with a joint framework of two vapor chambers, more than two vapor chambers can form a joint framework. FIG. 6 shows a joint framework of three vapor chambers 11, 21, 51 also characterized in that two paired vapor chambers are connected therebetween by a capillary pipe 31 and by a gas pipe 41, thereby allowing the two paired vapor chambers to operate jointly. Hence, according to the present invention, multiple vapor chambers are connected in order to operate jointly.

Therefore, the first preferred embodiment achieves advantages as follows:

First, the third wick 36 in the capillary pipe 31 enables the liquid-phase working fluid to flow to the first wick 16 or the second wick 26, whereas the gas pipe 41 enables the gas-phase working fluid to flow to the first room 14 or the second room 24; hence, after operating for a period of time, both the liquid-phase working fluid and the gas-phase working fluid reach equilibrium. Therefore, two vapor chambers are connected so that spaces therein are in communication with each other, allowing the two vapor chambers to operate jointly, so as to achieve the objectives of the present invention.

Second, the vapor chambers are tightly adhered to heat sources, respectively, to effectuate heat dissipation and thus solve the problem with thermal resistance arising from contact with multiple heat sources, because both the capillary pipe and the gas pipe are resilient enough to fine-tune the heights of the vapor chambers.

Figure 7:
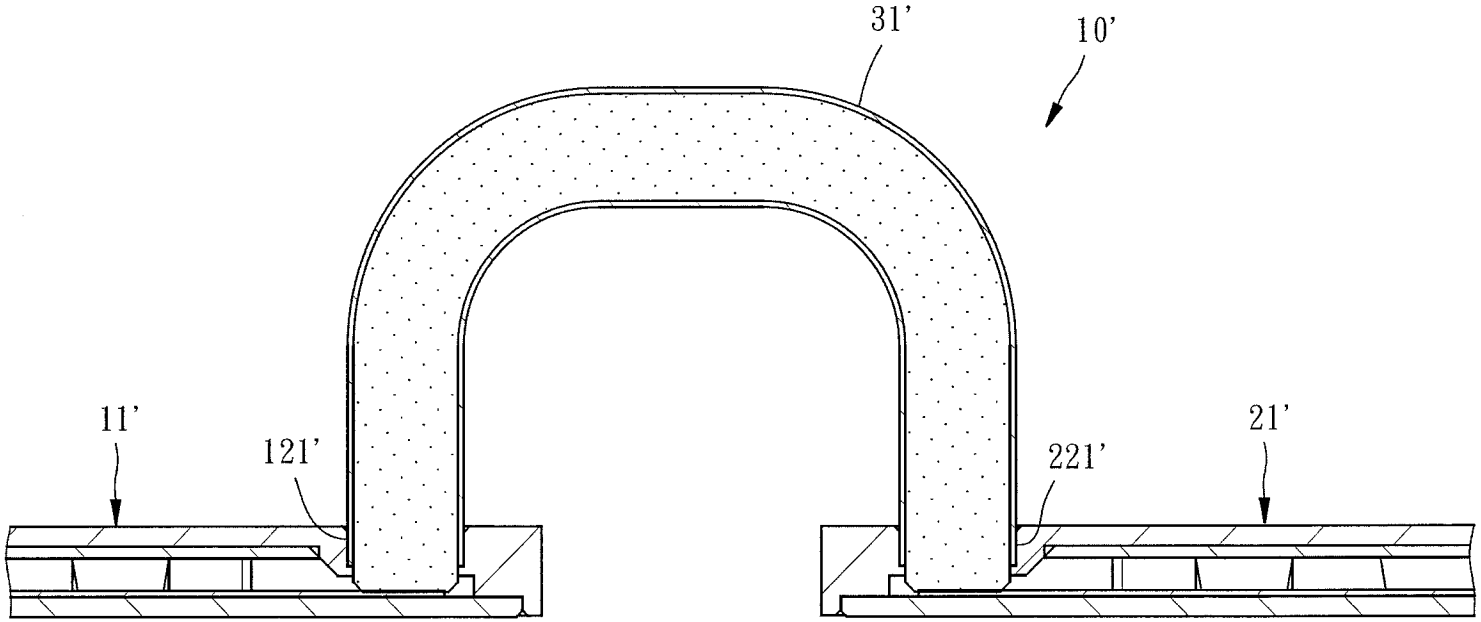
FIG. 7 is a cross-sectional view, taken from an angle similar to that of FIG. 4, of the joint assembly of vapor chambers according to the second preferred embodiment of the present invention.
Figure 8:
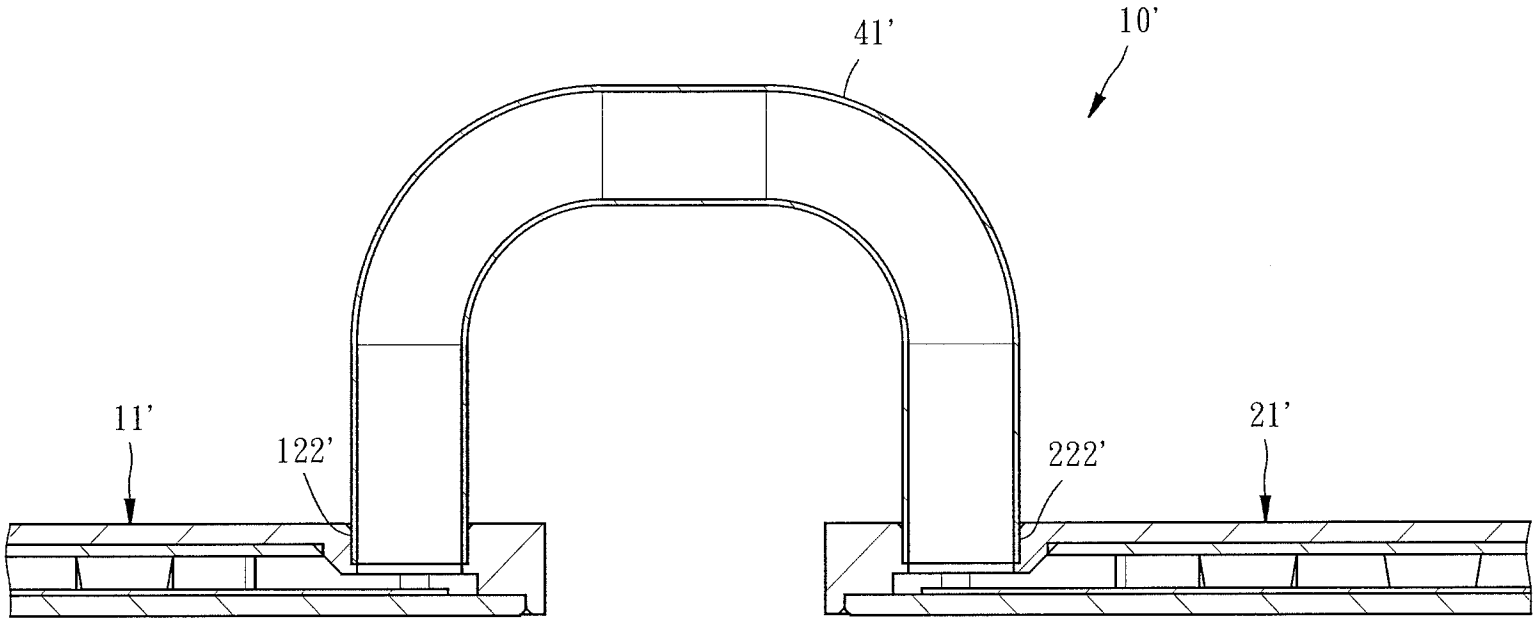
FIG. 8 is a cross-sectional view, taken from an angle similar to that of FIG. 5, of the joint assembly of vapor chambers according to the second preferred embodiment of the present invention.

Referring to FIG. 7 and FIG. 8, a joint assembly 10' of vapor chambers provided according to the second preferred embodiment of the present invention is distinguished from the joint assembly 10' of vapor chambers provided according to the first preferred embodiment of the present invention by technical features described below.

One end of a capillary pipe 31' and one end of a gas pipe 41' are inserted into a first connection hole 121' and a first gas hole 122' of a first vapor chamber 11' and thus surrounded by the wall of the first connection hole 121' and the wall of the first gas hole 122', respectively. The other end of the capillary pipe 31' and the other end of the gas pipe 41' are inserted into a second connection hole 221' and a second gas hole 222' of a second vapor chamber 21' and thus surrounded by the wall of the second connection hole 221' and the wall of the second gas hole 222', respectively.

As revealed above, the way that the capillary pipe 31' and the gas pipe 41' each connect the first vapor chamber 11' and the second vapor chamber 21' in the second preferred embodiment is different from their counterparts in the first preferred embodiment, but the first and second preferred embodiments are equally effective in connecting the first and second vapor chambers firmly.

The other structures and achievable advantages of the second preferred embodiment are substantially the same as those of the first preferred embodiment and thus, for the sake of brevity, are not described hereunder.

What is claimed is:

1. A joint assembly of vapor chambers, comprising:

at least two vapor chambers, a capillary pipe and a gas pipe which are each connected between two paired ones of the at least two vapor chambers, defining one of the two paired vapor chambers as a first vapor chamber, and defining the other vapor chamber as a second vapor chamber;

wherein the first vapor chamber has a casing which is panel-shaped, with a first room disposed in the casing, a first wick disposed on an inner wall surface of the casing and in the first room, the first room not fully occupied with the first wick, and the casing of the first vapor chamber is penetrated by a first connection hole and a first gas hole, with the first gas hole being in spatial communication with a first through-hole of the first wick;

wherein the second vapor chamber has a casing which is panel-shaped, with a second room disposed in the casing, a second wick disposed on an inner wall surface of the casing and in the second room, the second room not fully occupied with the second wick, and the casing of the second vapor chamber is penetrated by a second connection hole and a second gas hole, with the second gas hole being in spatial communication with a second through-hole of the second wick;

wherein two ends of the capillary pipe are connected to the casings of the first vapor chamber and the second vapor chamber and thereby are in communication with the first connection hole and the second connection hole, respectively, and the capillary pipe is filled with a third wick, with the third wick extending into the first connection hole and connecting with the first wick in the first vapor chamber, also with the third wick extending into the second connection hole and connecting with the second wick in the second vapor chamber, thereby allowing the third wick in the capillary pipe to close a cross section of the capillary pipe and prevent passage of gas;

wherein two ends of the gas pipe are connected to the casings of the first vapor chamber and the second vapor chamber and thereby are in communication with the first gas hole, the second gas hole, the first through-hole and the second through-hole, respectively, so that the first room and the second room are in spatial communication with each other because of the gas pipe; and a working fluid filled in the first room and the second room and absorbed by the first wick, the second wick and the third wick as a result of the connection of the first wick, the second wick and the third wick.

2. The joint assembly of vapor chambers of claim 1, wherein the third wick is solid and fully fills the capillary pipe.

3. The joint assembly of vapor chambers of claim 2, wherein a portion of the third wick, which extends into the first connection hole and connects with the first wick, is solid, whereas a portion of the third wick, which extends into the second connection hole and connects with the second wick, is solid.

4. The joint assembly of vapor chambers of claim 1, wherein a coupling wall rising from rims of the first connection hole and the first gas hole of the casing of the first vapor chamber surrounds terminal circumferential surfaces of the capillary pipe and the gas pipe, and a coupling wall rising from rims of the second connection hole and the second gas hole of the casing of the second vapor chamber surrounds terminal circumferential surfaces of the capillary pipe and the gas pipe.

5. The joint assembly of vapor chambers of claim 1, wherein an end of the capillary pipe and an end of the gas pipe are inserted into the first connection hole and the first gas hole of the first vapor chamber and thus surrounded by a wall of the first connection hole and a wall of the first gas hole, respectively, another end of the capillary pipe and another end of the gas pipe are inserted into the second connection hole and the second gas hole of the second vapor chamber and thus surrounded by a wall of the second connection hole and a wall of the second gas hole, respectively.

6. The joint assembly of vapor chambers of claim 1, wherein the first connection hole and the first gas hole are disposed on a same side of the casing of the first vapor chamber, whereas the second connection hole and the second gas hole are disposed on a same side of the casing of the second vapor chamber.

* * * * *